United States Patent [19]

Bühlmann

[11] Patent Number: 4,981,265

[45] Date of Patent: Jan. 1, 1991

[54] LIQUID DISTRIBUTOR FOR MASS-TRANSFER AND HEAT-EXCHANGE COLUMNS

[75] Inventor: Ulrich Bühlmann, Biel-Benken, Switzerland

[73] Assignee: Kühni AG., Allschwil, Switzerland

[21] Appl. No.: 321,090

[22] Filed: Mar. 9, 1989

[30] Foreign Application Priority Data

Mar. 22, 1988 [CH] Switzerland ..... 01078/88

[51] Int. Cl.[5] ..... B01F 3/04

[52] U.S. Cl. ..... 239/193; 261/97

[58] Field of Search ..... 261/DIG. 44, 97, 110, 261/112.1; 239/193

[56] References Cited

U.S. PATENT DOCUMENTS

| | | | |
|---|---|---|---|
| 3,937,769 | 2/1976 | Strigle et al. | 261/97 |
| 4,159,291 | 6/1979 | Bruckert et al. | 261/97 X |
| 4,264,538 | 4/1981 | Moore et al. | 239/193 X |
| 4,267,978 | 5/1981 | Mantcufel | 239/193 |
| 4,432,913 | 2/1984 | Harper et al. | 239/193 X |
| 4,557,877 | 12/1985 | Hofstetter | 261/97 |

FOREIGN PATENT DOCUMENTS 3409524 9/1985 Fed. Rep. of Germany ..... 261/97

*Primary Examiner*—Andres Kashnikow
*Assistant Examiner*—Kevin P. Weldon
*Attorney, Agent, or Firm*—Brady, O'Boyle & Gates

[57] ABSTRACT

The liquid distributor has several horizontal channels (2), the sidewalls (6, 7) of which are penetrated by vertical or inclined drain slots (10) spaced apart in the longitudinal direction of the channel. At each drain slot, a plate-shaped baffle element (12) projects from the channel sidewalls (6, 7). The baffle element (12) has a baffle surface (11) directly adjoining the drain slot (10) and projecting outwardly from the channel sidewall (6, 7), and accommodates the entire amount of liquid exiting from the drain slot (10) and conducts this liquid to a (single) drainage and/or drip-off point (16). The drainage and/or drip-off point (16) is located at the lower end of the bottom edge (14) of the baffle element (12), this edge extending obliquely downwardly away from the channel (2). The liquid distributor provides locally exactly defined drainage or drip-off points, uniform liquid distribution being achieved independently of the load. The local arrangement of the drainage or drip-off points can be chosen extensively independently of the position and width of the channels.

25 Claims, 3 Drawing Sheets

LIQUID DISTRIBUTOR FOR MASS-TRANSFER AND HEAT-EXCHANGE COLUMNS

The invention relates to a liquid distributor for mass-transfer and heat-exchange columns, comprising several at least approximatly horizontal channels, the sidewalls of which are provided with downwardly extending drain slots.

Liquid distributors for mass-transfer and heat-exchange columns serve for distributing the liquid over the packings or filling materials installed in the column. A maximally uniform distribution of the liquid over the column cross section is required for a maximally optimal exchange efficiency. The entire quantity of liquid should be divided into a plurality of equal-sized component streams arranged uniformly over the entire column cross section.

Such liquid distributors are utilized mainly in rectifying and absorption columns wherein a vapor or gas stream and a liquid stream are brought into contact, in most cases in countercurrent fashion with respect to each other. It is important for these utilizations for the liquid distributors to exhibit a small installation height and to be usable in a large load range, as well.

A large number of liquid distributors is known which can be classified into two categories according to their basic functional principle.

One group encompasses liquid distributors operating according to the efflux principle. The liquid is distributed among openings below the liquid level, the efflux velocity, in accordance with Torricelli's theorem, being proportionate to the root of the head h.

Conventional arrangements of this type of liquid distributors are box-like or tubular distributors with holes on the underside or in the sidewall for the efflux of the liquid. Such distributors have been described in DOS No. 2,102,424 and EP-A No. A 0 112 978. The general drawback exhibited by these distributors resides in the small load range and the large installation height required on account of the indicated connection between the efflux velocity and the square root of the head. In case the efflux holes are mounted, as holds true for most cases, on the underside of the distributing tubes and/or boxes, the additional disadvantage arises that the efflux holes are quickly clogged.

The other group of liquid distributors operates in accordance with the overflow principle. The liquid is distributed over rectangular or triangular overflow weirs or slots arranged in the sidewalls of open channels. The average discharge velocity w in this case is proportional to $h^{3/2}$ for rectangular slots and $h^{5/2}$ for triangular slots, respectively.

The liquid distributors counted among this group display the drawback that the distribution of the liquid is inaccurate. Even relatively minor deviations from the horizontal bring about, especially in case of low heads h, a nonuniform distribution of the liquid; this can be proven by means of the indicated relationship between the efflux velocity and the head.

Conventional arrangements of this type of liquid distributors have the additional, significant disadvantage that a uniform pattern of the drainage points over the column cross section cannot be attained, or can be provided only imperfectly and, in part, only with the use of an extremely complicated construction. In the simple trough-type distributors with slots in the sidewalls of open, rectangular channels, the point of liquid drainage points is not defined. In case of small amounts of liquid, the latter runs downwardly along the channel wall and drips down. In case of large quantities of liquid, in contrast thereto, the liquid flows over the channel wall and falls downwardly at a spacing in an irregular and uncontrolled fashion.

DOS No. 2,945,103 discloses a liquid distributor provided, in the form of a box-type distributor, with rectangular as well as triangular slots in the sidewalls. The liquid is conducted, with the aid of a second sidewall in parallel to the channel wall, toward drainage tabs bent away from the channel wall on alternating sides. Apart from the extremely expensive design, there is no assurance whatever that an equally large amount of liquid flows onto each drainage tab.

EP-A No. A 231,841 discloses a liquid distributor wherein the liquid exits in parallel to the channel wall, due to distributing channels offset in the longitudinal direction, and is drained off directly by means of baffle devices vertically in the downward direction. This distributing system has the essential drawback that the liquid is drained only directly below the boxes. Depending on the selected number of drainage points, it is necessary, on the one hand, to provide excessively broad boxes or, alternatively, a large number of boxes, resulting in a high pressure drop on the gas side. Also, another drawback in this arrangement resides in that the discharge slots cannot be manufactured with the precision required for uniform distribution.

Based on the aforedescribed disadvantages, liquid distributors according to the overflow principle are hardly utilized although they have the advantage of a large load range, generally require only a small installation height, and also show little sensitivity to clogging with solids.

The invention is based on the object of providing a liquid distributor of the type discussed in the foregoing operating according to the overflow principle, this distributor fulfilling the basic requirements for an exactly uniform distribution of liquid over the column cross section with the aid of a simple and economical structure.

This object has been attained by the invention as characterized in claim 1. The dependent claims recite advantageous special embodiments of the invention.

The invention will be described in greater detail below with reference to embodiments illustrated in the drawings wherein.

Figure 7:
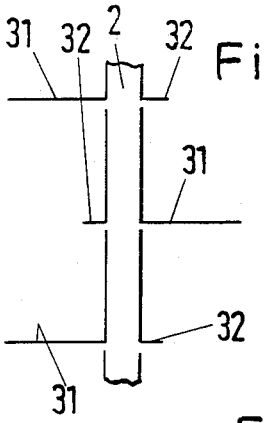
Figure 1:
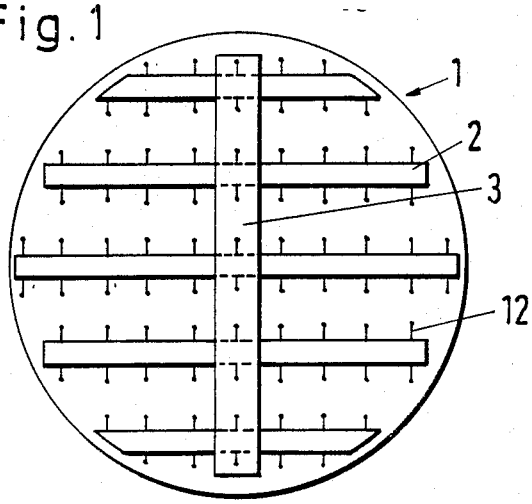
FIG. 1 is a top view of a mass-transfer column with liquid distributor.
Figure 2:
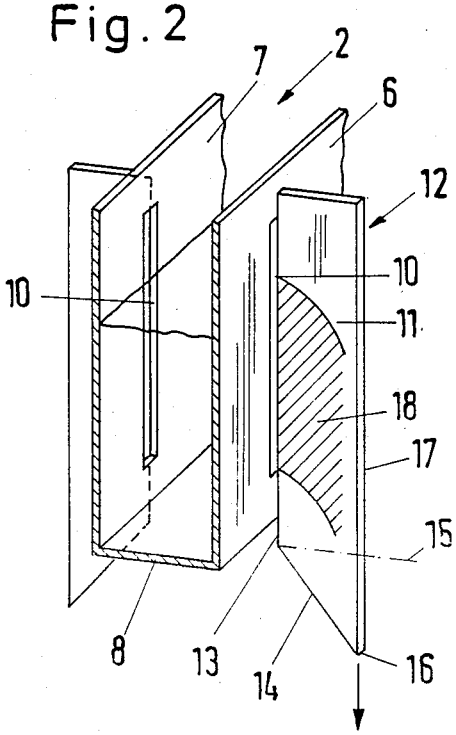
FIG. 2 shows part of a channel of a liquid distributor for mass-transfer columns, with two drain slots associated with respectively one baffle element.
Figure 12:
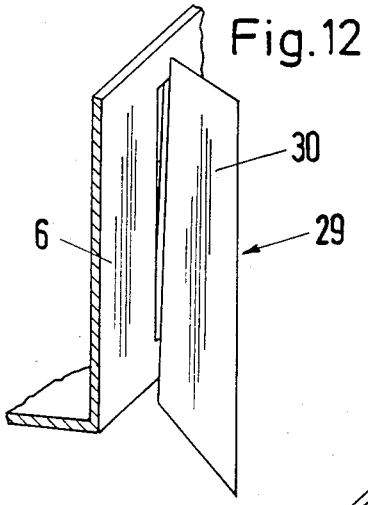
Figure 13A:
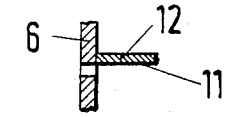
Figure 13B:
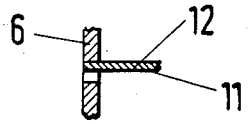
Figure 13C:
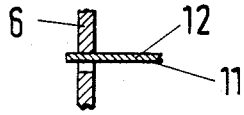
Figure 13D:
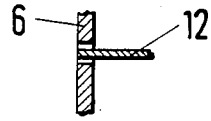
Figure 10:
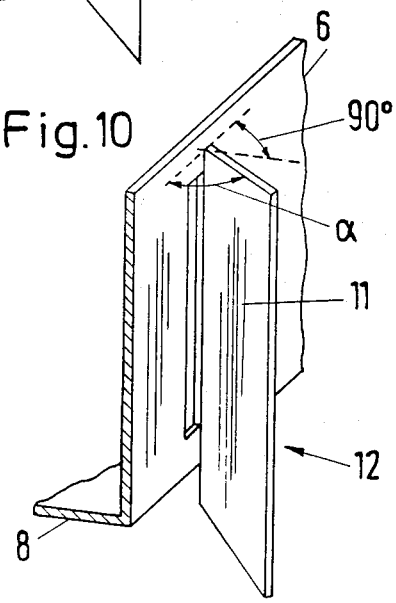
Figure 11:
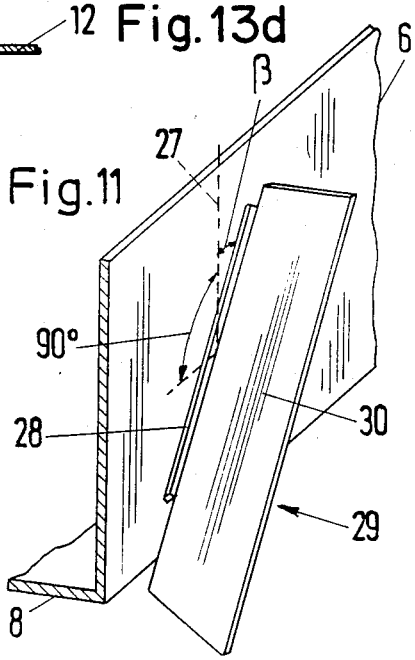
Figure 8:
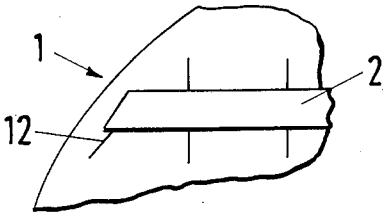
Figure 9:
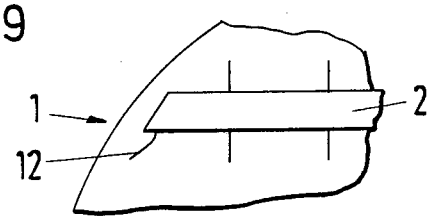

FIGS. 3, 4, 5*a*, 5*b*, 5*c*, 6*a* and 6*b* show various embodiments of the baffle elements, partially with deflecting elements, FIGS. 7–9 show a partial top view of versions of the liquid distributor of the mass-transfer column according to FIG. 1, FIG. 10 shows a part of FIG. 2 with a baffle element that is differently arranged, FIG. 11 shows a part of FIG. 2 with a different arrangement of the drain slot and of the associated baffle element, FIG. 12 illustrates a part of FIG. 2 with a different design of the drain slot and of the associated baffle element, and FIGS. 13*a*, 13*b*, 13*c*, and 13*d* show various arrangements of a baffle element at a drain slot.

The liquid distributor of the mass-transfer column 1 according to FIG. 1 consists of several horizontal channels 2 arranged in parallel to one another and extending below a conventional predistributor 3 arranged transversely above the channels 2; this predistributor distributes the liquid uniformly among the channels 2. The channels 2 are of a rectangular cross section, open at the top, and consist of two sidewalls 6 and 7 and a bottom 8, as shown in FIG. 2. The channels 2 are sealed at their ends.

According to FIG. 2, the sidewalls 6 and 7 of channels 2 are provided with elongated, narrow vertical slots 10 extending transversely, preferably perpendicularly to the longitudinal channel extension, through the sidewalls and terminating at the top as well as at the bottom at a distance from the rim of the sidewall. The slots can thus be cut into the sidewall in a simple way and with maximum precision in a mechanical procedure or also by wire erosion. The slit width of the slots ranges from about 0.5 to 1.5 mm, whereas the slot length is very long as compared with the slot width and can amount to 60–120 mm. On account of this extremely elongated slot configuration, a high head is reached even with small amounts of liquid so that a uniform liquid distribution to the individual slots is ensured at satisfactory accuracy.

One of the longitudinal rims of each slot 10 is directly followed along the entire slot length by a baffle surface 11 of a plate-shaped baffle element 12. By means of this simple arrangement, two important effects are achieved simultaneously, decisive for the uniform distribution of the liquid. On the one hand, the baffle surface immediately adjoining the slot causes the liquid, on account of the surface forces, to drain through the slot even in case of the required, small slot widths uniformly and at the same level at all slots. On the other hand, the baffle surface accommodates the entire liquid flowing through the slot and exiting vertically to the channel wall. The liquid spreads out as a film 18 on the baffle surface and flows to the drainage point which is arranged at an extensively freely selectable distance with respect to the channel 2.

The rim 14 defining the baffle surface 11 in the downward direction is designed so that liquid cannot drip down therefrom but rather flows therealong to the drip-off point. In FIG. 2, the rim 13 of the baffle surface 11 adjoining the sidewall 6 or 7, respectively, projects past the sidewall 6 or 7 and the horizontal bottom 8 of the channel 2 in the downward direction. The bottom rim 14 of the baffle surface 11 is accordingly located below the bottom 8 and extends obliquely downwardly away from the channel 2, i.e. inclined with respect to the horizontal 15, so that the baffle surface 11 has an acute-angled outer bottom corner 16 constituting the (sole) drainage or drip-off point for the entire liquid running through the slot 10 onto the baffle surface 11. The angle is selected so that the liquid follows the rim 14 and does not drip off.

Figure 3:
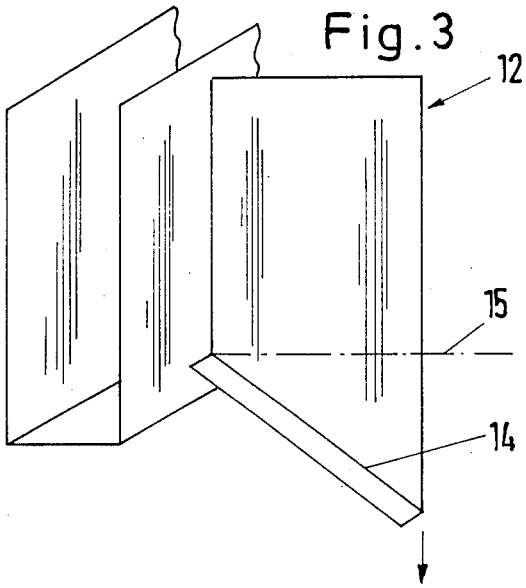

FIG. 3 shows another embodiment wherein the rim 14 begins directly below the slot 10. This rim is likewise inclined with respect to the horizontal 15, but is additionally angled by 90°. This arrangement is advantageous if small amounts of liquid are to be conducted for a relatively far distance from the channel to the drainage point.

Figure 4:
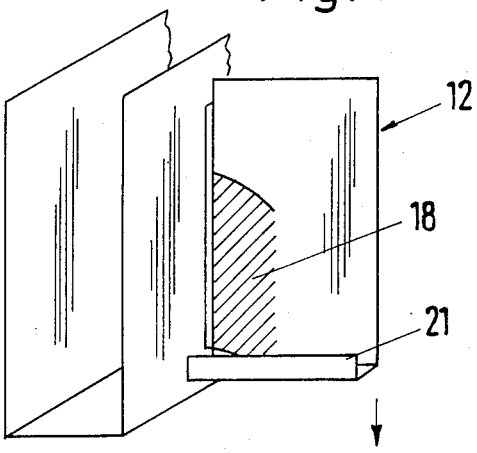

Finally, the bottom rim 14 can also extend horizontally, as illustrated in FIG. 4. However, in such a case it must be designed as a trough 21.

Figure 5A:
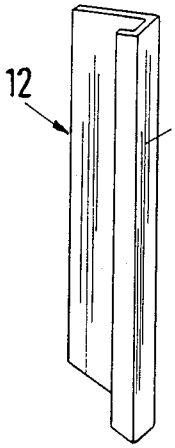
Figure 5B:
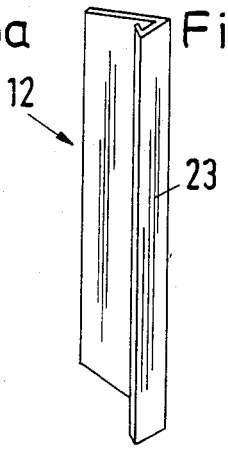
Figure 5C:
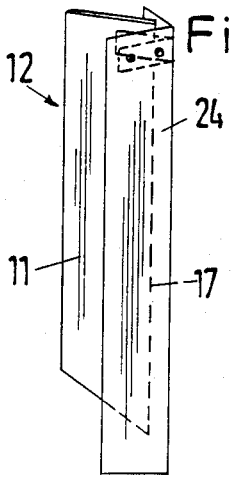
Figure 6B:
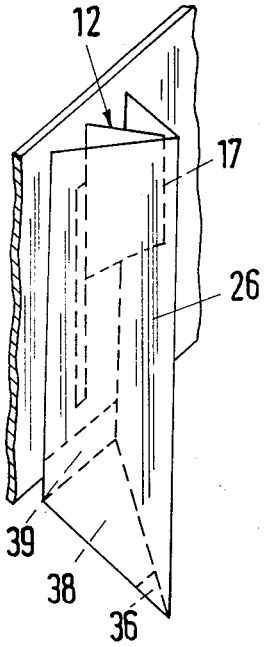
Figure 6A:
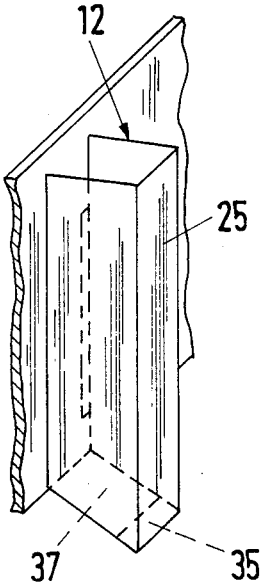

In order to cause the liquid to drain downwardly as a vertical stream in the entire load range, i.e. in case of small and medium but also very large liquid quantities, at the intended drip-off point 16, a deflecting element is preferably arranged at the lateral rim 17 of the baffle surface 11 facing away from the channel 2. This deflecting element has the task of collecting the liquid, spread at differing extents over the baffle surface 11 depending on the amount of liquid, and deflecting the liquid in a stream vertically in the downward direction. Such deflecting elements can be designed in the form of vertically downwardly extending troughs. FIGS. 5*a*, 5*b* and 5*c* show possible embodiments of such troughs 22, 23, 24; in FIGS. 5*a* and 5*b*, the lateral rim 17 of the baffle element 12 proper, facing away from channel 2, is formed to constitute the trough 22, 23. In FIG. 5*c*, the trough 24 is arranged on both sides of the baffle element 12 and, respectively, the baffle surface 11, and symmetrically thereto at a small spacing from its lateral rim 17, ensuring an especially uniform drainage of the liquid. The spacing of the apical edge of the trough 24 from the lateral rim 17 is approximately equal to the slot width of the slot 10 or is at most slightly larger than the slot width and is about 0.5–3 mm. The conduits 22, 23, 24 can also be round, instead of being rectangular or V-shaped. They need not extend up to the top rim of the baffle surface 11. Almost closed conduits have proven to be especially expedient, such as, for example, the trough 23 illustrated in FIG. 5*b*, leaving only a narrow entrance slot open for the liquid. This ensures that the liquid is not only deflected but also is focused into a jet. Of course, it is also possible to provide an angled termination and/or a trough 21 (FIG. 3 or 4) at the bottom rim 14, as well as a conduit 22, 23, 24 (FIGS. 5*a*, 5*b*, 5*c*) on the lateral rim 17 of the baffle surface 11 facing away from the channel; in this arrangement, an opening constituting a drainage or drip-off point is to be formed in the corner 16 between the two conduits. If the spacing of the drip-off point from the side channel wall 6 is small, the sidewall of the deflecting element 22 facing the channel wall 6 or, respectively, both sidewalls of the deflecting element 24 can extend up to the channel sidewall 6 and can be firmly joined thereto. Such deflecting elements 25, 26 are illustrated in FIGS. 6*a* and 6*b*. In FIG. 6*b* the lower portion of baffle 11 is broken away and omitted for clarity in showing deflecting element 26 and bottom 38 to be described. The deflecting elements 25, 26 with their sidewalls and baffle elements 12 in close contact with the channel wall 6 are closed off at the bottom except for a drainage opening 35, 36; for this purpose, the deflecting element 25 has an inclined, rectangular bottom 37 closely adjoining the bottom edge of the sidewall 6, and the deflecting element 26 has an inclined, trapezoidal bottom 38 and a flange 39 firmly attached to the sidewall 6 and extending at an angle to this bottom. Thereby, in a simple way, a completely closed baffle element-deflecting element unit is formed.

Thus, the baffle element 12 consists essentially of a baffle surface 11, a bottom rim 14 guiding the liquid at least in the bottom zone of the baffle surface 11 and preventing the liquid from dripping down, as well as of a deflecting element collecting the entire liquid, deflecting same vertically downwardly, and allowing same to exit as a single jet. In the simplest case, the baffle element consists of a flat plate, that is, it is planar, the surface and rims of which fulfill the above-described functions.

FIG. 7 shows how it is possible to achieve, with baffle elements 31, 32 of differing width, a uniform distribution of the drainage or drip-off points in the form of a triangular division. For an optimal adaptation of the drip-off point distribution to the round column cross section, it is advantageous, as shown in FIGS. 8–10, to be able to arrange external drip-off points with a displacement in the longitudinal channel direction with respect to the outlet slot 10. For this purpose, the angle $\alpha$ formed by the baffle surface 11 arranged at the channel end with the sidewall 6 or 7 can amount, in a deviation from FIGS. 1 and 2, to less than 90°, as illustrated by FIG. 10, so that the baffle element 12 extends obliquely toward the channel wall 6. Another possibility, as shown in FIG. 9, resides in designing the baffle element 12 to be slightly curved, i.e. bent toward the channel wall, the baffle surface 11 coming into contact with the channel wall 6 at a right angle.

In order to protect the liquid exiting from slot 10 from the upwardly oriented gas flow, especially at high gas velocities, it can be advantageous to design the slot to be inclined, rather than vertical, in a deviation from FIGS. 2 and 10, so that also the baffle surface adjoining a slot rim is inclined, and the liquid flows along an oblique plane to the drainage or drip-off point; compare the slot 28, inclined by the angle $\beta$ with respect to the vertical 27, and the correspondingly obliquely arranged baffle element 29 with the baffle surface 30 in FIG. 11. Additionally, a trough 21 (FIG. 4) and/or one of the conduits 22–26 (FIGS. 5 and 6) can also be provided at the element 29, just as in case of the element 12.

The slots need not necessarily be designed with parallel rims. Rather, the slot width can also decrease from the top toward the bottom (FIG. 12); in this connection, the inclination of the baffle elements according to FIG. 11 is advantageous. Here again, the baffle surface 11 directly adjoins one of the longitudinal rims of the slot 10. With this slot configuration, the load range can be further enlarged.

FIGS. 13*a*, 13*b*, 13*c*, and 13*d* illustrate various arrangements of a baffle element 12 at a drain slot 10. According to FIG. 13*a*, the baffle surface 11 directly adjoins one of the slot rims. According to FIG. 13*b*, the baffle surface 11 in the slot forms one of the efflux slot rims, the baffle element 12 also constituting one of the efflux slot walls. According to FIG. 13*c*, the baffle element 12 can extend with the baffle surface 11 additionally past the sidewall 6 toward the inside. According to FIG. 13*d*, the baffle element 12 divides the slot into two drain slots thus yielding two baffle surfaces, and one or several conduits (FIGS. 3, 4, 5, 6), if they are to be used, must be arranged on both sides of the baffle element. The arrangements wherein the baffle element 12 extends with the baffle surface 11 into the efflux slot (FIG. 13*b*, FIG. 13*d*) and, respectively, through this slot (FIG. 13*c*), exhibit the advantage that the liquid enters the baffle surface as early as within the drain slot, leading especially in case of small slot widths to a more uniform efflux of the liquid and thereby to an improved distribution accuracy.

The distributing channels 2 can also be V-shaped in cross section with inclined sidewalls 6 and 7 converging into one line at the bottom. The drain slots 10 and the correspondingly adapted baffle elements 12 are then mounted to the inclined sidewalls.

I claim:

1. A liquid distributor for mass-transfer and heat-exchange columns, comprising a plurality of at least approximately horizontal channels (2) having longitudinally extending sidewalls (6, 7), elongated, narrow downwardly extending drain slots (10) in said sidewalls (6, 7) having a slot width and a slot length, the slot length being a multiple of the slot width, whereby on account of the extremely elongated slot configuration, a high head of liquid in the channels is reached even with a small flow of liquid into the channels (2) and a uniform distribution of liquid to the individual drain slots (10) is ensured, a baffle element (12) for each of said drain slots (10), said baffle element (12) having a plate (11) which directly adjoins said drain slot (10) and projects outwardly from the channel sidewall (6, 7), said plate (11) extending at least along the entire length of said slot (10), being planar at least in the vicinity of said slot (10) and having a liquid drainage drip-off means (36) at its lower end, said plate (11) causing the liquid to drain uniformly through the slot (10) and at the same level at all said slots (10) and accommodating all the liquid exiting from the slot (10) and conducting the liquid, which is spreading out on the plate (11), towards said liquid drainage drip-off means (36).

2. A liquid distributor according to claim 1, in which said plate (11) has a bottom edge (14) extending downwardly and outwardly away from said channel sidewall (6, 7).

3. A liquid distributor according to claim 1, in which said plate (11) has a bottom edge (14) angled downwardly away from said channel (2).

4. A liquid distributor according to claim 1, in which said plate (11) has an edge (13) which directly adjoins said drain slot (10) and channel sidewall (6, 7), and which extends below the bottom of said channel sidewall (6, 7).

5. A liquid distributor according to claim 2, in which said bottom edge (14) is positioned directly below said drain slot (10).

6. A liquid distributor according to claim 1, in which said plate (11) is connected at right angles to said channel sidewall (6, 7).

7. A liquid distributor according to claim 1, in which said slot width is in the range of 0.5–1.5 mm, and said slot length is in the range of 100 mm.

8. A liquid distributor according to claim 1, in which said plate (11) directly adjoining said drain slot (10) extends into said drain slot (10).

9. A liquid distributor according to claim 8, in which plate extending into said drain slot (10) divides said drain slot into two drain slots.

10. A liquid distributor according to claim 8, in which plate extending into said drain slot (10) extends through said drain slot (10).

11. A liquid distributor according to claim 10, in which said channel sidewall (6, 7) has an inside surface inside said channel (2), and said plate (11) extending through said drain slot (10) projects inwardly of said channel beyond said inside surface of said channel sidewall (6, 7).

12. A liquid distributor according to claim 1, in which said downwardly extending drain slot (10) are disposed perpendicular to said longitudinally extending sidewalls (6, 7), whereby liquid exits through said slots (10) perpendicular to the longitudinal direction of the channel (2).

13. A liquid distributor according to claim 1, in which said downwardly extending drain slots (10) are disposed transverse to said longitudinally extending sidewalls (6, 7), whereby liquid exits through said slots (10) transverse to the longitudinal direction of the channel (2).

14. A liquid distributor for mass-transfer and heat-exchange columns comprising a plurality of at least approximately horizontal channels (2) having a longitudinally extending sidewalls (6, 7), said sidewalls (6, 7) having elongated, narrow downwardly extending drain slots (10) having a slot width and a slot length, the slot length being a multiple of the slot width, and providing an extremely elongated slot configuration, whereby a high head of liquid in the channels is reached even with a small flow of liquid into the channels (2) and a uniform distribution of liquid to the individual drain slots (10) is ensured.

a baffle element (12) for each of said drain slots (10), said baffle element (12) having a plate (11) directly adjoining said drain slot (10) and projecting outwardly from the channel sidewall (6, 7), said plate (11) extending at least along the entire length of said slot (10), being a planar at least in the vicinity of said slot (10) and having a liquid drainage drip-off means (36) at its lower end, said baffle element (12) further having deflecting means (22, 23, 24, 25, 26) connected for guiding the liquid to said liquid drainage drip-off means (36), said plate (11) causing the liquid to drain uniformly through the slot (10) and at the same level at all said slots (10) and accommodating all the liquid exiting from the slot (10) and conducting and guiding with the aid of said deflecting means (22, 23, 24, 25, 26) the liquid, which is spreading out on the plate (11), towards said liquid drainage drip-off means (36).

15. A liquid distributor according to claim 14, wherein said plate (11) has a lateral edge (17) facing away from said drain slot (10), said deflecting means consist of a deflecting member (22, 23, 24, 25, 26) extending along at least a bottom portion of said lateral edge (17) of said plate (11), and said liquid drainage drip-off means (36) being at the lower end of said lateral edge (17) and said deflecting member (26), respectively.

16. A liquid distributor according to claim 14, in which said plate (11) has a lateral edge (17) facing away from said drain slot (10), and said deflecting means comprises a deflecting member (24, 26) connected to extend along and in outwardly spaced relation to said lateral edge (17).

17. A liquid distributor according to claim 16, in which said deflecting member (24, 26) is connected to extend on both sides of said plate (11) and to encompass said lateral edge.

18. A liquid distributor according claim 14, in which said plate (11) has a lateral edge (17) facing away from said drain slot (10), and said deflecting means comprises a trough-like deflecting member (22, 23, 24, 25, 26) connected with said lateral edge (17) to direct liquid flowing toward the lateral edge of said plate (11) downwardly.

19. A liquid distributor according to claim 18, in which said trough-like deflecting member (24, 26) extends on both sides of said plate (11) and symmetrically to said plate (11).

20. A liquid distributor according to claim 16, in which the space between said deflecting member (24, 26) and said lateral edge (17) is a small space corresponding approximately to said slot width.

21. A liquid distributor according to claim 19, in which said trough-like deflecting member (24, 26) is spaced outwardly from said lateral edge (17).

22. A liquid distributor according to claim 19, and said trough-like deflecting member (26) having deflector walls extending toward and connected to said channel sidewall (6, 7).

23. A liquid distributor according to claim 22, and a bottom wall (38) closing the bottom of said deflector member (26), whereby said plate (11) and deflector member (26) form a closed unit with said sidewall (6, 7), and said liquid drainage drip-off means comprises a drainage opening (36) in the end of said bottom wall (38) facing away from said channel sidewall (6, 7).

24. A liquid distributor according to claim 14, in which said plate (11) is connected at right angles to said channel sidewall (6, 7).

25. A liquid distributor according to claim 14, in which said slot width is in the range of 0.5–1.5 mm, and said slot length is in the range of 100 mm.

* * * * *